US005604965A

United States Patent [19]

Shaw et al.

[11] Patent Number: 5,604,965

[45] Date of Patent: Feb. 25, 1997

[54] DECORATIVE HARDWARE FOR CASKET

[75] Inventors: Charles B. Shaw; David A. Hazelett, both of Lynn; Ronald G. Williams, Connersville, all of Ind.; David D. Shook, Ansonia, Ohio

[73] Assignee: Astral Industries Inc., Lynn, Ind.

[21] Appl. No.: 526,131

[22] Filed: Sep. 5, 1995

Related U.S. Application Data

[63] Continuation of Ser. No. 94,716, Jul. 20, 1993, abandoned.

[51] Int. Cl.[6] ..... A61G 17/00

[52] U.S. Cl. ..... 27/2; 27/1; 27/10; 16/112

[58] Field of Search ..... 27/1, 2, 10, 12, 27/27, 35; 16/110 R, 111 R, 112; 24/289, 290

[56] References Cited

U.S. PATENT DOCUMENTS

| | | | |
|---|---|---|---|
| 849,669 | 4/1907 | Fisk | 16/112 |
| 958,114 | 5/1910 | Hammond | 16/112 |
| 2,450,091 | 9/1948 | Kendall | 27/2 |
| 3,025,624 | 3/1962 | Harrell | 27/1 |
| 3,204,286 | 9/1965 | Hillenbrand | 16/112 |
| 3,962,761 | 6/1976 | Boughner | 27/10 |
| 4,068,347 | 1/1978 | Jonhson et al. | 27/2 |
| 4,195,394 | 4/1980 | Semon | 27/2 |
| 4,403,380 | 9/1983 | Hazelett | 27/12 |
| 4,571,790 | 2/1986 | James, III | 27/10 |
| 4,615,085 | 10/1986 | Hartman | 27/1 |
| 4,800,631 | 1/1989 | Pellmann | 27/7 |
| 5,241,729 | 9/1993 | MacKirby | 27/2 |

*Primary Examiner*—Kien T. Nguyen
*Attorney, Agent, or Firm*—Baker & Daniels

[57] ABSTRACT

A casket includes a plurality of walls. An attaching device is connected to at least one of the walls for non-removably attaching decorative hardware to the exterior of the casket without accessing the interior of said casket. The decorative hardware includes a decorative body portion and an engaging device. The engaging device provides attachment of the decorative hardware to the attaching device without the use of tools.

15 Claims, 4 Drawing Sheets

DECORATIVE HARDWARE FOR CASKET

This is a continuation of application Ser. No. 08/094,716, filed Jul. 20, 1993 now abandoned.

BACKGROUND OF THE INVENTION

1. Field of the Invention

The present invention relates to caskets, and, more particularly, to caskets having decorative hardware attached to the exterior thereof.

2. Description of the Related Art

Burial caskets typically include an elongated body portion and a corresponding top. Decorative upholstery is usually fastened to the interior of the casket, and decorative hardware may be fastened to the exterior of the casket. The decorative hardware may be made of suitable material such as metal, plastic, or wood. The shape, color and material of the decorative hardware may vary with an individual casket depending on religious beliefs, personal taste, and cost of the casket.

It is known in the art to fasten decorative hardware to the exterior of a casket using fasteners such as bolts which pass through the decorative hardware and the body portion of a casket. An example of such decorative hardware is disclosed in U.S. Pat. No. 3,025,624 issued to Harrell. Such decorative hardware, however, requires alteration of the body portion of the casket such as providing apertures for fasteners to pass through to attach the decorative hardware. Moreover, tools are required to attach such decorative hardware to the casket. Further, fasteners used to attach the decorative hardware to the casket are visible and detract from the aesthetic appeal of the casket.

It is also known, e.g., from U.S. Pat. No. 2,450,091 issued to Kendall, to attach a fastening means to the backside of decorative hardware such that the fastening device, a bolt for instance, is not visible from the front of the decorative hardware. Because the fastening device is attached to the backside of the decorative hardware, it is necessary for the fastening device to extend through the casket body or top so that the decorative hardware can be drawn securely against the body or top. It is therefore necessary to alter the body portion of the casket and to access the interior of the casket to attach the decorative hardware. It is undesirable to access the interior of a casket for this purpose as it entails the possibility of damage to the decorative interior upholstery of the casket.

Corner pieces for a casket may be attached by forming each corner piece with a portion at each outward end thereof which engages the top rail and bottom rail of the casket. Such a corner piece is disclosed in U.S. Pat. No. 4,195,394 issued to Semon. A corner piece having a portion thereof which extends over the top rail may, however, interfere with sealing of the casket between the body and top. Moreover, it may be desirable, e.g., for aesthetic appeal, to have a corner piece which extends between the top and bottom rail, but which does not extend over the top and bottom rail. Finally, such a corner piece is undesirably removable from the casket without the use of tools.

Decorative hardware of conventional design is not easily attached to the exterior of a casket. Providing a casket having a specific combination of decorative hardware therefore requires two conventional solutions directed to the problem of overcoming the aforementioned difficulty of attachment. One solution is to maintain a large inventory of caskets having various configurations of decorative hardware. Maintaining a large inventory of variously decorated caskets allows prompt shipment of a casket upon receipt of an order, but undesirably increases capital required for maintaining such a large inventory.

An alternative solution is to maintain a plurality of caskets in stock with little or no decorative hardware attached thereto. Upon receipt of a customer order, desired decorative hardware may be attached to the exterior of the casket immediately prior to shipment. However, as noted above, conventional decorative hardware requires the use of tools and/or access to the interior of the casket. The use of tools to tighten fastening devices for attaching the decorative hardware to the casket increases labor costs associated with the casket. Furthermore, accessing the interior of a casket may result in damage to or soiling of the upholstery.

What is needed in the art is a casket to the exterior of which various types and configurations of decorative hardware may be fastened without the use of tools and without accessing the interior of the casket whereby a basic casket can be stocked which can be decorated depending on the desires of the customer. Such an arrangement would drastically reduce the needed inventory of caskets.

Furthermore, what is needed is a casket including decorative hardware which is attached to the casket without the use of tools but which cannot be easily removed from the casket.

An additional need in the art is decorative hardware which may be fastened to the exterior of a casket without the use of tools, and which does not result in visible and unsightly fastening hardware for attaching the decorative hardware to the exterior of the casket.

SUMMARY OF THE INVENTION

The present invention provides decorative hardware which is attached to the exterior of the casket without accessing the interior of the casket.

The casket includes a plurality of walls defining a body portion and a top. An attaching device is connected to the exterior side of one of the walls. Decorative hardware is non-removably connected to the attaching device without the use of tools. In an installed position, the decorative hardware substantially covers the attaching device so that the attaching device cannot be seen.

The invention comprises, in one form thereof, a casket including a plurality of walls. An attaching means is connected to at least one of the walls for non-removably attaching decorative hardware to the exterior of the casket without accessing the interior of said casket. The decorative hardware includes a decorative body portion and an engaging device. The engaging device provides attachment of the decorative hardware to the attaching means without the use of tools.

An advantage of the present invention is that decorative hardware may be fastened to the exterior of a casket without accessing the interior of a casket.

Another advantage is that decorative hardware may be fastened to the exterior of a casket without the use of tools.

A still further advantage is that decorative hardware may be fastened to the exterior of a casket without the use of tools, but the decorative hardware can be removed from the casket only with the use of tools.

A still further advantage is that the decorative hardware substantially covers a device used to attach the decorative hardware to the exterior of the casket.

A still further advantage is that an attaching device may be attached to a corner of a casket which will non-removably engage a decorative corner configured with one of a plurality of exterior sizes and shapes.

Another advantage is that decorative hardware may be stored separate from a casket and quickly and easily attached to the casket upon receipt of an order from a customer so that the required inventory of caskets is substantially reduced.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views, The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
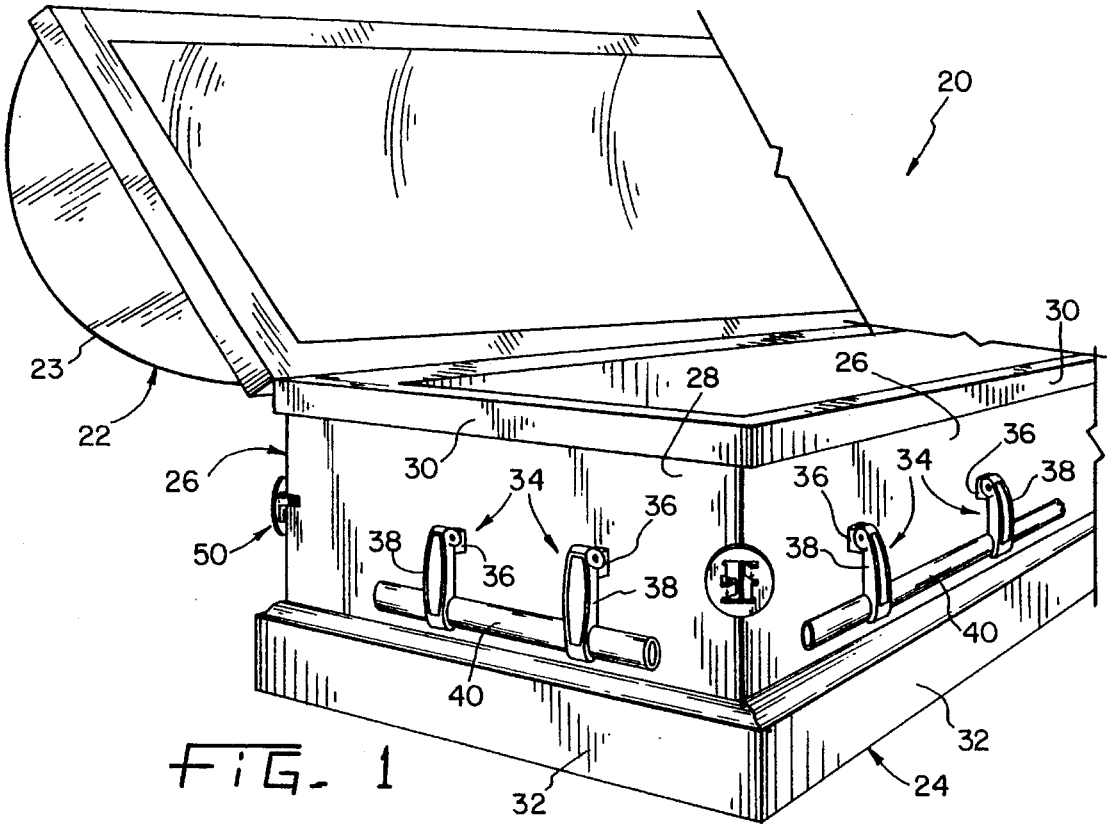
FIG. 1 is a fragmentary perspective view of a casket shown without decorative hardware.
Figure 2:
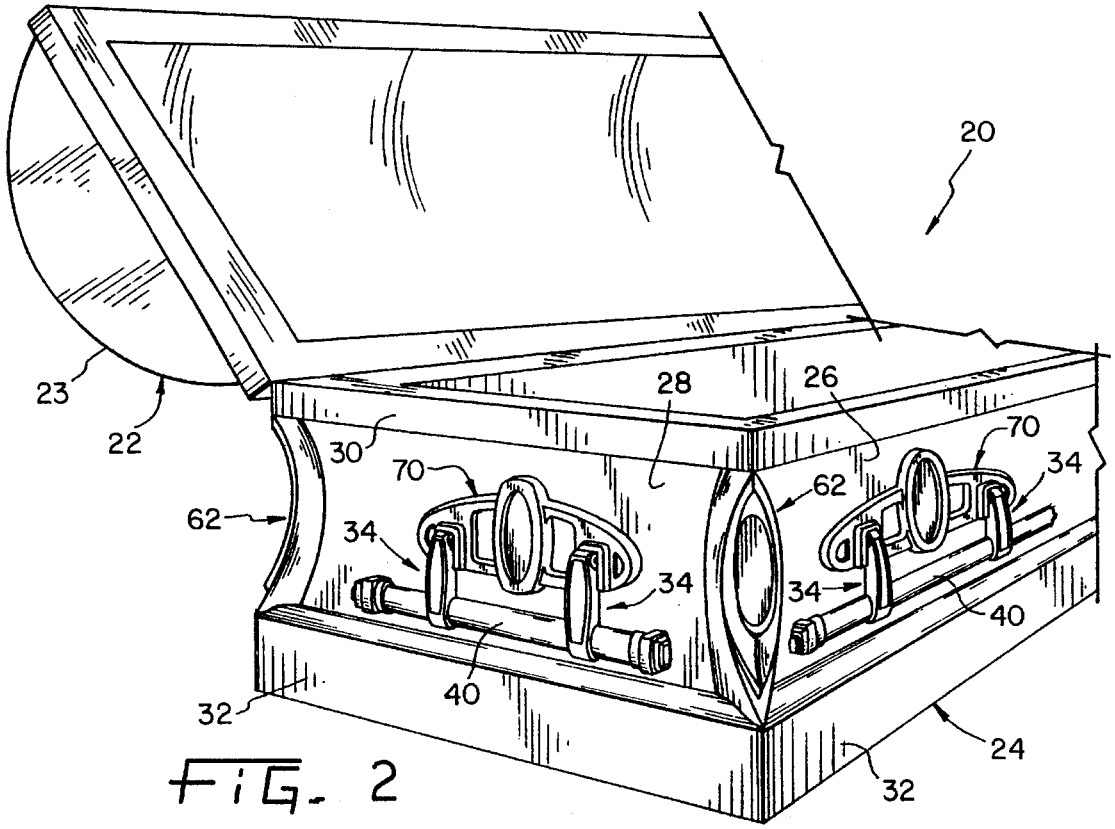
FIG. 2 is a fragmentary perspective view of the casket of FIG. 1 shown with decorative hardware attached thereto.
Figure 3:
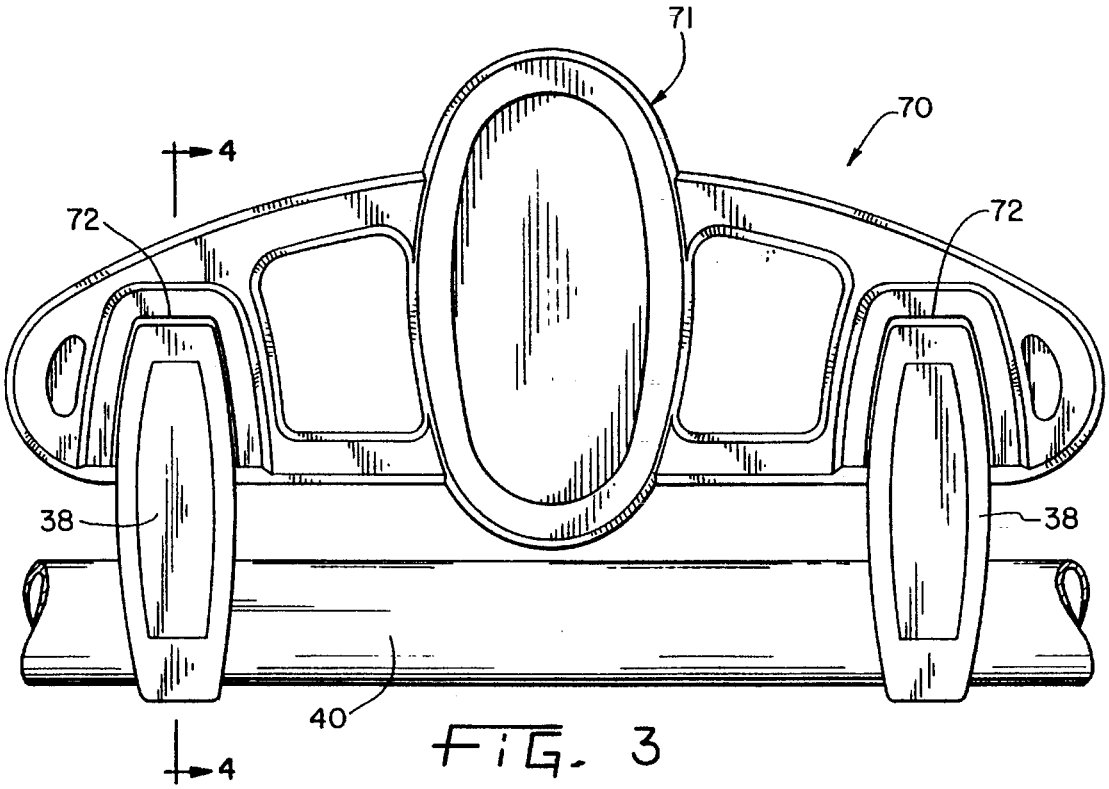
FIG. 3 is an enlarged fragmentary view of a handle assembly of the present invention with a decorative plate installed.

Referring now to the drawings and particularly to FIG. 1, there is shown a casket 20 including a plurality of walls defining a top 22 and body 24. Top 22 includes a generally arcuately shaped top wall 23. Body 24 includes sidewalls 26, endwalls 28, and a bottom (not shown). Sidewalls 26 and endwalls 28 may be generally planar or may include a top rail 30 and bottom rail 32.

Figure 4:
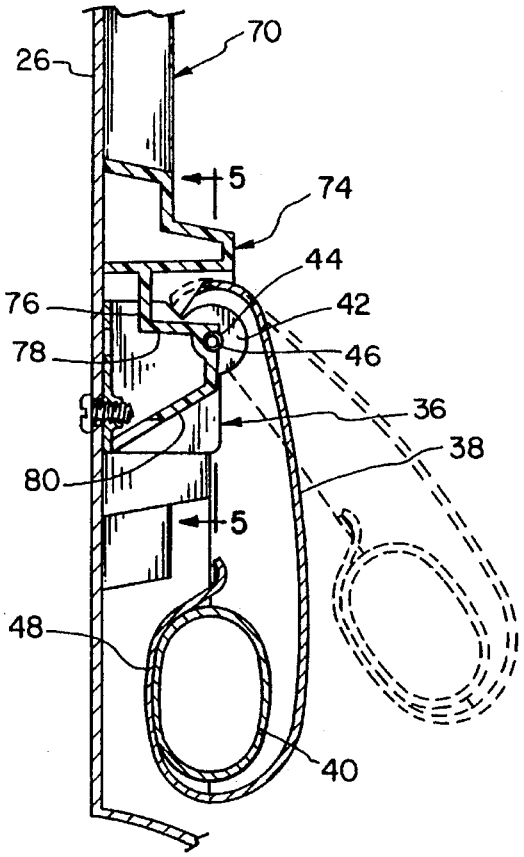
FIG. 4 is a sectional view taken along line 4—4 in FIG. 3.
Figure 6:
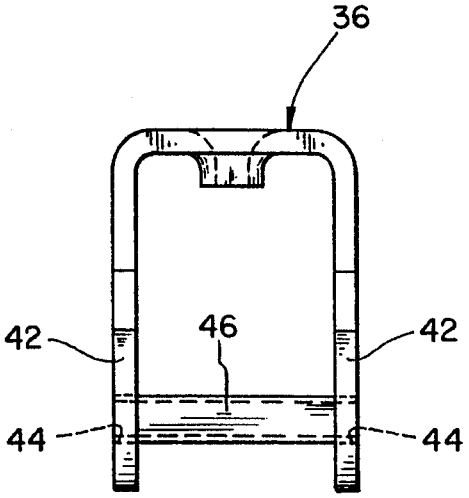
FIG. 6 is a top view of the clevis shown in FIGS. 1 and 4.

Handle assembly 34 is used to lift casket 20. Handle assembly 34 may be either a stationary or swing bar-type assembly. The embodiment shown in the drawings depicts a swing bar-type assembly having a swing bar which may be rotated from a first generally vertical position to a second outwardly rotated position (FIG. 4). Handle assembly 34 includes a clevis 36, arm 38, and swing bar 40. Clevis 36 is attached directly to one of the walls of casket 20. Clevis 36 is generally U-shaped including parallel leg portions 42 having apertures 44 formed therein for receiving a pivot pin 46 (FIG. 6).

Arm 38, as shown in FIG. 4, pivots about pivot pin 46 in known fashion. Arm 38 includes an elongated portion 48 for attachment to swing bar 40.

Figure 10:
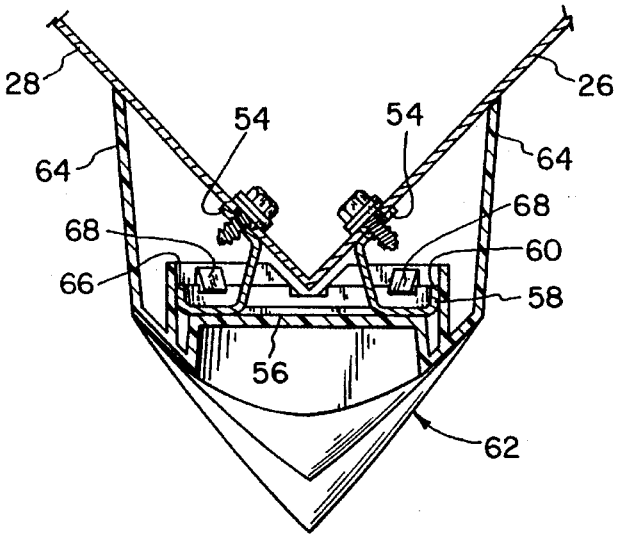
FIG. 10 is a sectional top view of the decorative corner shown in FIG. 8 attached to the casket with an attaching means.
Figure 12:
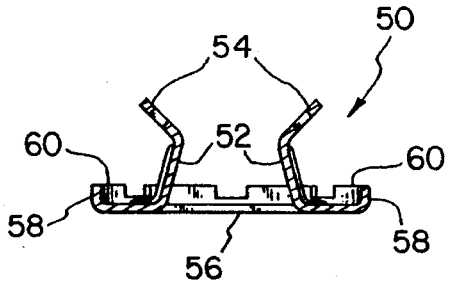
FIG. 12 is a sectional top view of the attaching means shown in FIGS. 9–10 taken along line 12—12.
Figure 11:
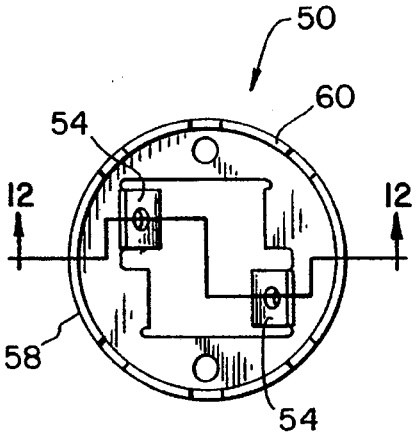
FIG. 11 is a rear view of the attaching means shown in FIG. 10.

In accordance with the present invention, casket 20 includes an attaching device 50 which is connected to an exterior corner of the casket at a location where exterior trim is to be attached. In the embodiment shown, attaching device 50 includes a pair of legs 52 respectively having an outer end portion 54 disposed at about a 90° angle relative to each other (FIGS. 11 and 12). Outer end portions 54 are respectively attached to adjoining sidewall 26 and endwall 28 by suitable means, e.g., screws or bolts. Attaching device 50 includes a generally planar surface 56 adjoining a lip 58 defining a shoulder 60. Generally planar surface 56 is shown with a circular profile (FIG. 10); however, other configurations may be used.

Decorative corner 62 is non-removably attached to attaching device 50 without the use of tools. The term "non-removable", as used in this application, means that the decorative hardware cannot be removed without the use of tools. Thus, no tools are required to install corner 62, but tools are required to remove corner 62 from the casket.

Figure 8:
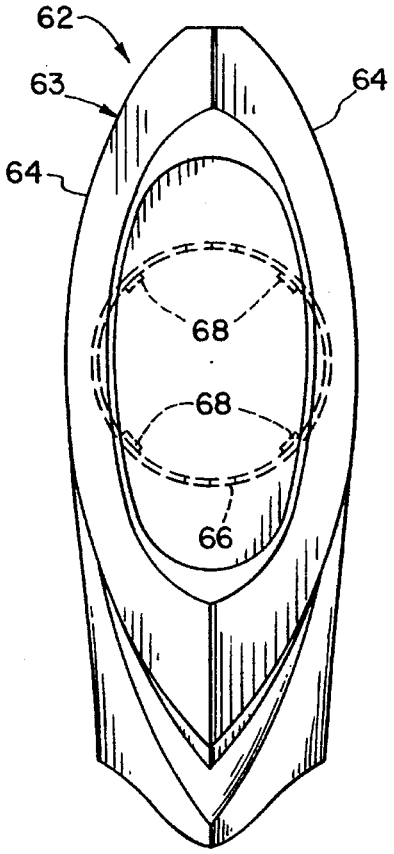
FIG. 8 is a plan view of a decorative corner shown in FIG. 2.
Figure 9:
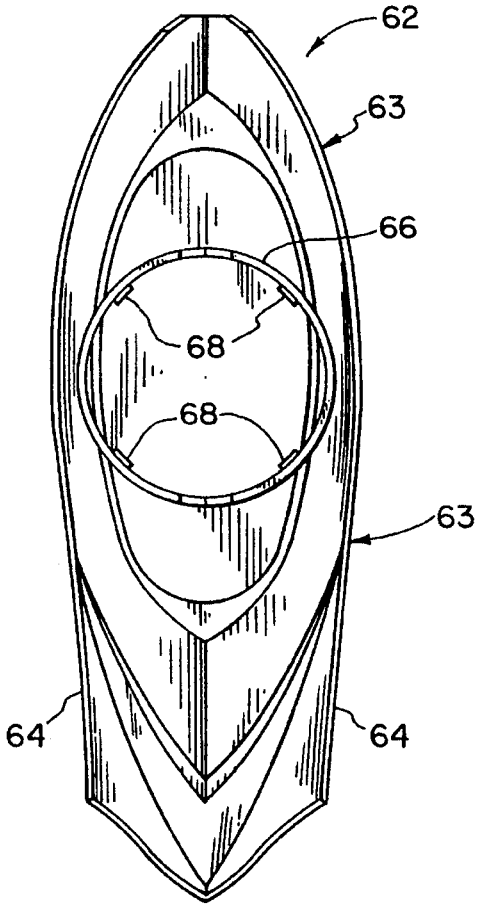
FIG. 9 is rear view of the decorative corner shown in FIG. 8.

Decorative corner 62 includes a body portion 63 having walls 64 which, when in an installed position, are disposed immediately adjacent sidewall 26 and endwall 28. Attached to the backside of decorative corner 62 (FIG. 8) is a snap ring 66 having inwardly projecting tabs 68.

To install decorative corner 62 on casket 20, snap ring 66 is placed adjacent attaching device 50. Decorative corner 62 is urged toward attaching device 50 and generally planar surface 56 and lip 58 slide into snap ring 66. As attaching device 50 is urged into snap ring 66, lip 58 biases inwardly projecting tabs 68 of snap ring 66 radially outward. As shoulder 60 of attaching device 50 is seated into snap ring 66, inwardly projecting tabs 68 are allowed to move radially inward of adjacent shoulder 60 and thereby inhibit removal of decorative corner 62.

Figure 5:
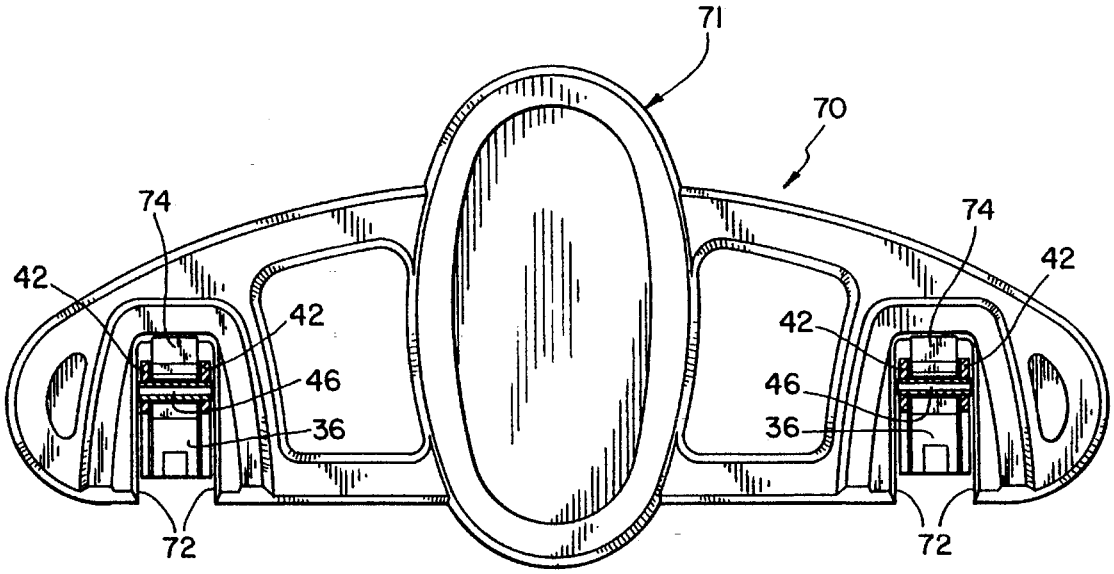
FIG. 5 is a sectional view taken along line 5—5 in FIG. 4.
Figure 7:
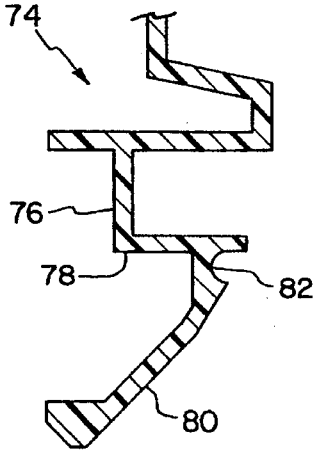
FIG. 7 is an enlarged side sectional view of the snap lug of the decorative plate shown in FIGS. 4 and 5.

Referring to FIGS. 2–5, a decorative plate 70 is shown in an installed position engaging handle assembly 34. It is to be appreciated that the size and shape of decorative plate 70 may vary. Each decorative plate 70 includes a body portion 71 having two cutout portions 72, each having an engaging member 74 centrally located therein (FIGS. 4, 5 and 7). Each engaging member 74 includes a spring-like portion defined by arm portions 76, 78 and 80 allowing engaging member 74 to be elastically deformed during installation of decorative plate 70. A notch 82, formed in arm portion 80, engages pivot pin 46 to provide a non-removable snap fit attachment of decorative plate 70 to handle assembly 34.

To attach decorative plate 70 to handle assembly 34, decorative plate 70 is placed above handle assembly 34 such that each engaging member 74 is respectively disposed directly above one of a pair of adjacent clevises 36. Each engaging member 74 is moved between parallel leg portions 42 of each respective clevis 36 until notch 82 of engaging member 74 engages pivot pin 46 of clevis 36. Decorative plate 70 may thus be non-removably installed without the use of tools.

To remove decorative plate 70, engaging member 74 may be deflected toward casket 20 with the use of a tool until notch 82 disengages from pivot pin 46. For example, a screw driver or the like may be inserted from the bottom side of clevis 36 between leg portions 42 and used to deflect engaging member 74. It is thus apparent that removal of decorative plate 70 requires the use of tools.

When decorative corner 62 and decorative plate 70 have been installed, attaching device 50 and clevis 36 are substantially surrounded by decorative corner 62 and decorative plate 70 respectively, thereby substantially preventing viewing of attaching device 50 and clevis 36. Further, installation of decorative plate 70 does not inhibit the operation of swing bar 40.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A casket, comprising:

a plurality of walls;

decorative hardware; and attaching means connected to at least one of said walls for attaching said decorative hardware to the exterior of said casket, said attaching means including means for preventing said decorative hardware from being pulled away from the side of said wall attached to said decorative hardware, whereby said decorative hardware can only be detached by accessing the interior of the casket.

2. A casket, comprising:

a plurality of walls;

decorative hardware; and attaching means connected to at least one of said walls for attaching said decorative hardware to the exterior of said casket, said attaching means including means for preventing said decorative hardware from being pulled away from the side of said wall attached to said decorative hardware, said attaching means interposed between said wall and said decorative hardware, whereby said decorative hardware can only be detached by accessing the interior of the casket.

3. The casket of claim 2, wherein said attaching means comprises a clevis.

4. The casket of claim 2, wherein said decorative hardware includes a spring-like portion and said attaching means includes a rigid mating portion, said spring-like portion engaging said rigid mating portion and thereby providing said attachment.

5. The casket of claim 4, wherein said rigid mating portion comprises a pin and said spring-like portion includes an indented portion engaging said pin.

6. The casket of claim 4, wherein said spring-like portion comprises a plurality of tabs and said rigid mating portion comprises a shoulder engaging said tabs.

7. A casket comprising:

a plurality of walls;

decorative hardware; and attaching means connected to at least one of said walls for removably attaching said decorative hardware to the exterior of said casket by means of a snap fit without accessing the interior of said casket, said attaching means interposed between said wall and said decorative hardware and comprising a snap ring, whereby said decorative hardware can only be detached by accessing the interior of the casket.

8. A casket, comprising:

a plurality of walls;

decorative hardware; and attaching means connected to at least one of said walls for attaching said decorative hardware, said attaching means including means for preventing said decorative hardware from being pulled away from the side of said wall attached to said decorative hardware, said decorative hardware substantially surrounding said attaching means whereby said attaching means cannot be easily seen and said decorative hardware can only be detached by using tools.

9. A casket, comprising:

a plurality of walls defining a casket exterior;

decorative hardware; and a handle assembly fastened to said casket exterior, said handle assembly including attaching means connected to at least one of said walls for removably attaching said decorative hardware to said casket exterior by means of a snap fit without accessing the interior of said casket whereby said decorative hardware substantially surrounds said attaching means and said decorative hardware can only be detached by accessing the interior of the casket.

10. A casket, comprising:

a plurality of walls;

decorative hardware; and a handle assembly fastened to said casket exterior, said handle assembly including an attaching means connected to at least one of said walls for removably attaching said decorative hardware to the exterior of said casket by means of a snap fit without accessing the interior of said casket, said decorative hardware including a spring-like portion and said attaching means comprising a clevis having a pin portion, said spring-like portion engaging said pin portion whereby said decorative hardware substantially surrounds said attaching means and said decorative hardware can only be detached by using tools.

11. A casket, comprising:

a plurality of walls, two of said walls disposed in adjoining relationship and defining a corner;

decorative corner hardware; and attaching means connected to at least one of said walls for removably attaching said decorative corner hardware to the exterior of said casket adjacent said corner without the use of tools, said attaching means including means for preventing said decorative hardware from being pulled away from the side of said wall attached to said decorative hardware, whereby said decorative hardware can only be detached by accessing the interior of the casket.

12. The casket of claim 11, wherein said attaching means provides attachment of said decorative corner without accessing the interior of said casket.

13. The casket of claim 11, wherein said attaching means is connected to two adjoining walls.

14. Decorative hardware for a casket, the casket including an attaching device on an exterior wall thereof, said decorative hardware comprising:

a decorative body portion; and engaging means for engaging the attaching device whereby said decorative hardware may be attached to the casket without the use of tools and without accessing the interior of said casket, said engaging means including means for preventing said decorative hardware from being pulled away from the side of the wall attached to said decorative hardware.

15. A casket adapted for receiving decorative hardware which includes an engagement portion with a snap fit attachment, said casket comprising:

a plurality of walls; and attaching means connected to at least one of said walls for attaching the decorative hardware to the exterior of said casket without the use of tools and without accessing the interior of said casket, said attaching means including means for engaging the engagement portion of the decorative hardware and preventing the decorative hardware from being pulled away from the side of said wall attached to the decorative hardware, whereby the decorative hardware can only be detached by using tools.

* * * * *